US009399201B1

(12) United States Patent
Wu et al.

(10) Patent No.: US 9,399,201 B1
(45) Date of Patent: Jul. 26, 2016

(54) HOMOGENIZER FOR REDUCING THE SIZE OF PARTICLES IN FLUIDS

(71) Applicant: Fristam Pumps USA, Limited Partnership, Middleton, WI (US)

(72) Inventors: Nanping Wu, Fitchburg, WI (US); Duane Dean Ehlke, Cross Plains, WI (US); Scott Thomas Haman, Madison, WI (US)

(73) Assignee: Fristam Pumps, USA, Middleton, WI (US)

( * ) Notice: Subject to any disclaimer, the term of this patent is extended or adjusted under 35 U.S.C. 154(b) by 432 days.

(21) Appl. No.: 14/039,518

(22) Filed: Sep. 27, 2013

Related U.S. Application Data

(60) Provisional application No. 61/706,902, filed on Sep. 28, 2012.

(51) Int. Cl.
*B01F 5/06* (2006.01)

(52) U.S. Cl.
CPC ..... *B01F 5/0664* (2013.01)

(58) Field of Classification Search
CPC ..... B01F 5/0664
USPC ..... 366/176.2, 176.1; 137/625.31, 625.28, 137/625.3
See application file for complete search history.

(56) References Cited

U.S. PATENT DOCUMENTS

| | | | | |
|---|---|---|---|---|
| 2,690,329 | A * | 9/1954 | Gressly | A01J 11/16 241/152.1 |
| 3,133,557 | A | 5/1964 | Gongwer | |
| 4,081,863 | A | 3/1978 | Rees | |
| 4,205,696 | A | 6/1980 | Gongwer | |
| 4,352,573 | A | 10/1982 | Pandolfe | |
| RE31,105 | E | 12/1982 | Bates | |
| 4,383,769 | A | 5/1983 | Pandolfe | |
| 4,585,357 | A | 4/1986 | Ogata | |
| 4,952,067 | A | 8/1990 | Dallas | |
| 5,749,650 | A | 5/1998 | Kinney | |
| 5,899,564 | A | 5/1999 | Kinney | |
| 6,234,206 | B1 | 5/2001 | Malmberg | |
| 6,238,080 | B1 * | 5/2001 | Jarchau | B01F 5/0664 137/625.3 |
| 6,244,739 | B1 | 6/2001 | Jarchau | |
| 6,305,836 | B1 | 10/2001 | Jarchau | |
| 2010/0329073 | A1 * | 12/2010 | Malmberg | A01J 11/16 366/176.3 |

FOREIGN PATENT DOCUMENTS

| | | | | |
|---|---|---|---|---|
| SE | WO 2009096825 | A1 * | 8/2009 | A01J 11/16 |

* cited by examiner

*Primary Examiner* — Charles Cooley
*Assistant Examiner* — Marc C Howell
(74) *Attorney, Agent, or Firm* — Craig A. Fieschko, Esq.; DeWitt Ross & Stevens S.C.

(57) ABSTRACT

An exemplary homogenizer includes a valve plate stack having a shim sandwiched by a pair of valve plates, the stack being concentrically aligned by a center stud. Each of the valve plates includes a middle annulus radially situated between an outer rim and an inner raised hub. Each middle annulus includes annulus apertures that help increase flow rate. When the homogenizer is in a working position, the valve plate stack is compressed, and fluid entering through an inlet is homogenized as it passes through a gap between outer rims of adjacent valve plates. The minimum gap between the valve plates is set by the thickness of the shim. In a cleaned-in-process cleaning position, pressure is relieved from the stack, and a spring between adjacent valve plates separates adjacent valve plates. Enhanced drainage, and springs that are substantially sealed from fluids by spring retainers and O-rings, help promote sanitation.

20 Claims, 6 Drawing Sheets

HOMOGENIZER FOR REDUCING THE SIZE OF PARTICLES IN FLUIDS

CROSS-REFERENCE TO RELATED APPLICATIONS

This application claims priority under 35 USC §119(e) to U.S. Provisional Patent Application 61/706,902 filed Sep. 28, 2012, the entirety of which is incorporated by reference herein.

FIELD OF THE INVENTION

This document concerns an invention relating generally to homogenizers useful for reducing the size of particles in fluid products, such as during the processing of milk and other dairy, food, beverage, and pharmaceutical products.

BACKGROUND OF THE INVENTION

Multi-plate homogenizers tend to have several drawbacks (with the following discussion referring to FIGS. 1 and 2 of U.S. Pat. No. 6,244,739 as an example). First, crevices are exposed to the fluid product (for example, the crevices seen between items 44 and 32, 32 and 33, 32 and 4, and between the valve plates). Product that remains in the crevices may not be adequately removed during cleaning, and can lead to microbe growth and product contamination issues.

Second, such homogenizers have springs (for example, wave springs 50) in grooves formed on the faces of adjacent stacked valve plates. When the springs expand, they (and the grooves) may be exposed to the product, making the residual product resistant to subsequent cleaning.

Third, such homogenizers rely on the springs between the valve plates to maintain alignment of the valve plate stack. However, due to variation in spring diameters, it is difficult to maintain concentricity of the neighboring valve plates, and clearances arise between the valve groove and the spring. This is particularly true if plates wear or break. Misalignment affects the effectiveness of the homogenization process, and additionally increases the likelihood of the valve stack's failure (for example, owing to force imbalances and/or compression on misaligned valves). What is needed is a homogenizer that addresses these and other drawbacks.

SUMMARY OF THE INVENTION

The invention, which is defined by the claims set forth at the end of this document, is directed to a homogenizer that at least partially alleviates the aforementioned problems. A basic understanding of some of the features of preferred versions of the invention can be attained from a review of the following brief summary of the invention, with more details being provided elsewhere in this document. To assist in the reader's understanding, the following review makes reference to the accompanying drawings (which are briefly reviewed in the "Brief Description of the Drawings" section following this Summary section of this document).

Referring to FIGS. 2 and 5, an exemplary homogenizer 10 for reducing the size of particles in fluids includes an inlet 20 for receiving a fluid and an outlet 30 through which fluid in the homogenizer 10 may exit. Fluid entering the homogenizer 10 through the inlet 20 is fed at least to a first valve plate 40 and an adjacent second valve plate 50. Each of the first and second valve plates 40, 50 includes an outer rim 60, an inner raised hub 70, and a middle annulus 80. The outer rim 60 has a rim thickness that is substantially equal to a hub thickness of the inner raised hub 70. The middle annulus 80, which is radially situated between the outer rim 60 and the inner raised hub 70, has an annulus thickness that is substantially less than the hub and rim thicknesses. The inner raised hub 70 includes a hub aperture 90 extending therethrough. A center stud 100 extends through the hub apertures 90 of the first and second valve plates 40, 50 to concentrically align the first valve plate 40 with the second valve plate 50.

A shim 110 with a shim thickness that is substantially less than the annulus thickness is sandwiched between the inner raised hubs 70 of the adjacent first and second valve plates 40, 50. The shim 110 has a shim diameter, and each of the inner raised hubs 70 of the first and second valve plates 40, 50 has a hub diameter. The shim diameter is no greater than the hub diameters of the inner raised hubs 70 so that the shim 110 does not extend beyond the inner raised hub 70. The shim 110 includes a shim aperture 120 extending therethrough, and the center stud 100 passes through the shim aperture 120 to concentrically align the shim 110 with the first and second valve plates 40, 50. The center stud 100 extends from a stud first end 130 to a stud second end 140, and the stud first and second ends 130, 140 are threaded. The threaded stud second end 140 engages a threaded hole 150 of a valve plate plunger 160. The threaded stud first end 130 receives a center stud nut 170, such that the first and second valve plates 40, 50 are situated between the valve plate plunger 160 and the center stud nut 170. The valve plate plunger 160 can press the first and second valve plates 40, 50 together to varying degrees.

Referring also to 6A and 6B, the homogenizer 10 is able to transition between a working position (FIG. 6A) and a cleaning position (FIG. 6B). In the working position, the valve plate plunger 160 is at substantially full compression, and the first and second valve plates 40, 50 are in full contact with the shim 110. The minimum valve plate gap between the inner raised hubs 70 of the first and second valve plates 40, 50 is set by the shim thickness, and the valve plate gap is at least substantially equal to the shim thickness in the working position. The valve plate gap may be (for example) between 0.001 inch and 0.002 inch in the working position. The homogenizer 10 further includes a spring 180 situated between the middle annuluses 80 of the adjacent first and second valve plates 40, 50. The spring 180 is biased to push the first and second valve plates 40, 50 apart. In the cleaning position, the spring 180 separates the first and second valve plates 40, 50 such that the valve plate gap is greater than the shim thickness. The valve plate gap may be (for example) between 0.03 inch and 0.05 inch in the cleaning position. The spring 180 may be substantially sealed from fluids by a spring retainer 190 and spring O-rings 200. Each of the middle annuluses 80 of the first and second valve plates 40, 50 includes at least one annulus aperture 210. When the homogenizer 10 is in a working position, fluid entering through the inlet 20 is at least partly homogenized as it travels through the valve plate gap between outer rims 60 of adjacent valve plates 40, 50, 55 and to an annular cavity 240 surrounding the valve plates 40, 50, 55.

The exemplary homogenizer 10 promotes more sanitary usage because there are no (or minimal) crevices and/or springs 180 exposed to the fluid product being homogenized. For example, residual product is less likely to be left in the homogenizer 10 between operating runs, and/or after flushing or other cleaning operations. The homogenizer 10 also allows for more efficient CIP (cleaned-in-process or cleaned-in-place) cleaning because, for example, it has self-draining capability when being flushed or otherwise cleaned in its cleaning position. That is, no (or minimal) drying or application of pressurized air is needed to remove residual cleaning fluid. The homogenizer 10 may have a compact and robust construction that is capable of high throughput while maintaining part alignment during high/turbulent flow. In particular, valve plates may be stacked about the center stud 100 for alignment and stability, whereby alignment is maintained even if the spring 180 fails. Further advantages and features of the invention will be apparent from the remainder of this document in conjunction with the associated drawings.

DETAILED DESCRIPTION OF PREFERRED VERSIONS OF THE INVENTION

Figure 1:
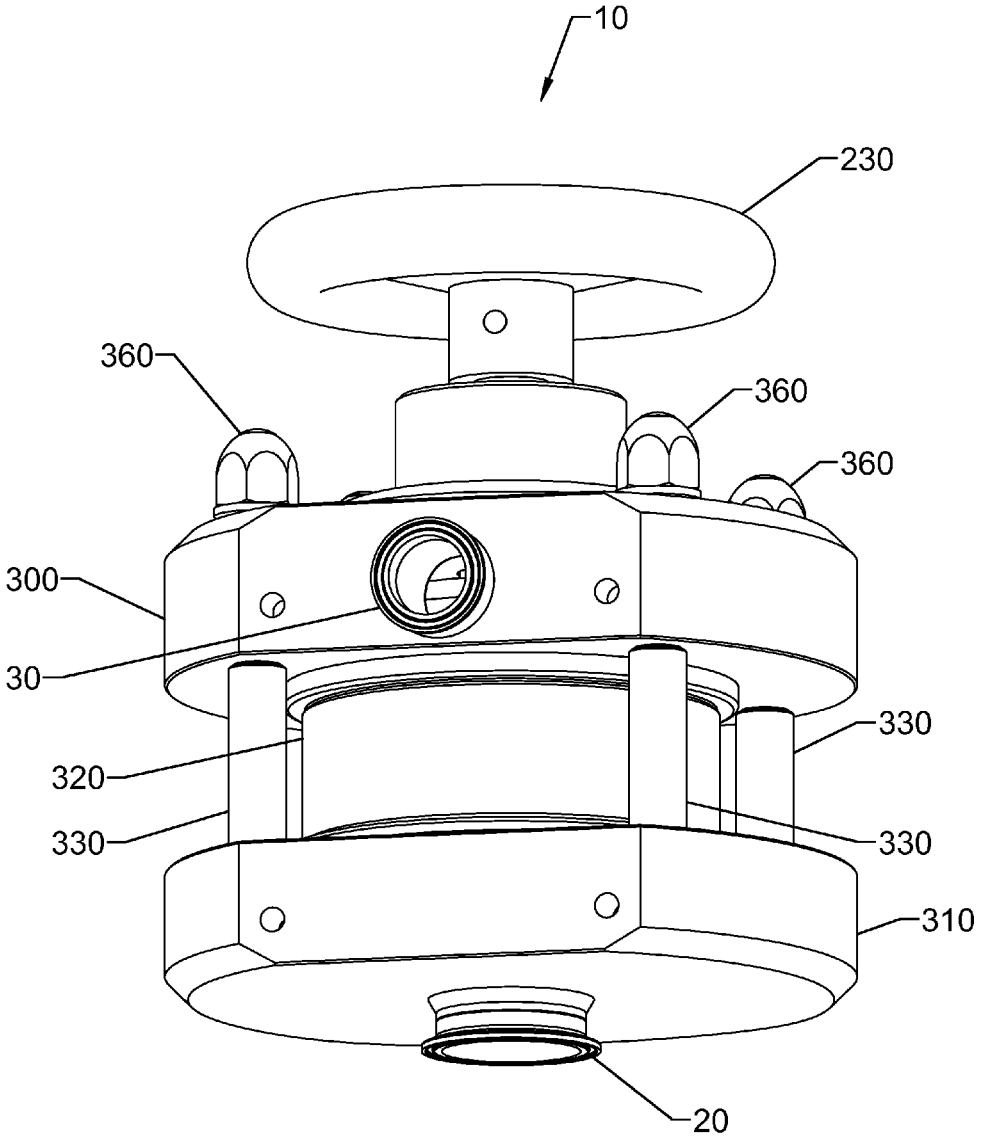
FIG. 1 is a perspective view of an assembled exemplary homogenizer 10 in a working position, showing a fluid input at the bottom side and a fluid output at a midsection thereof.
Figure 2:
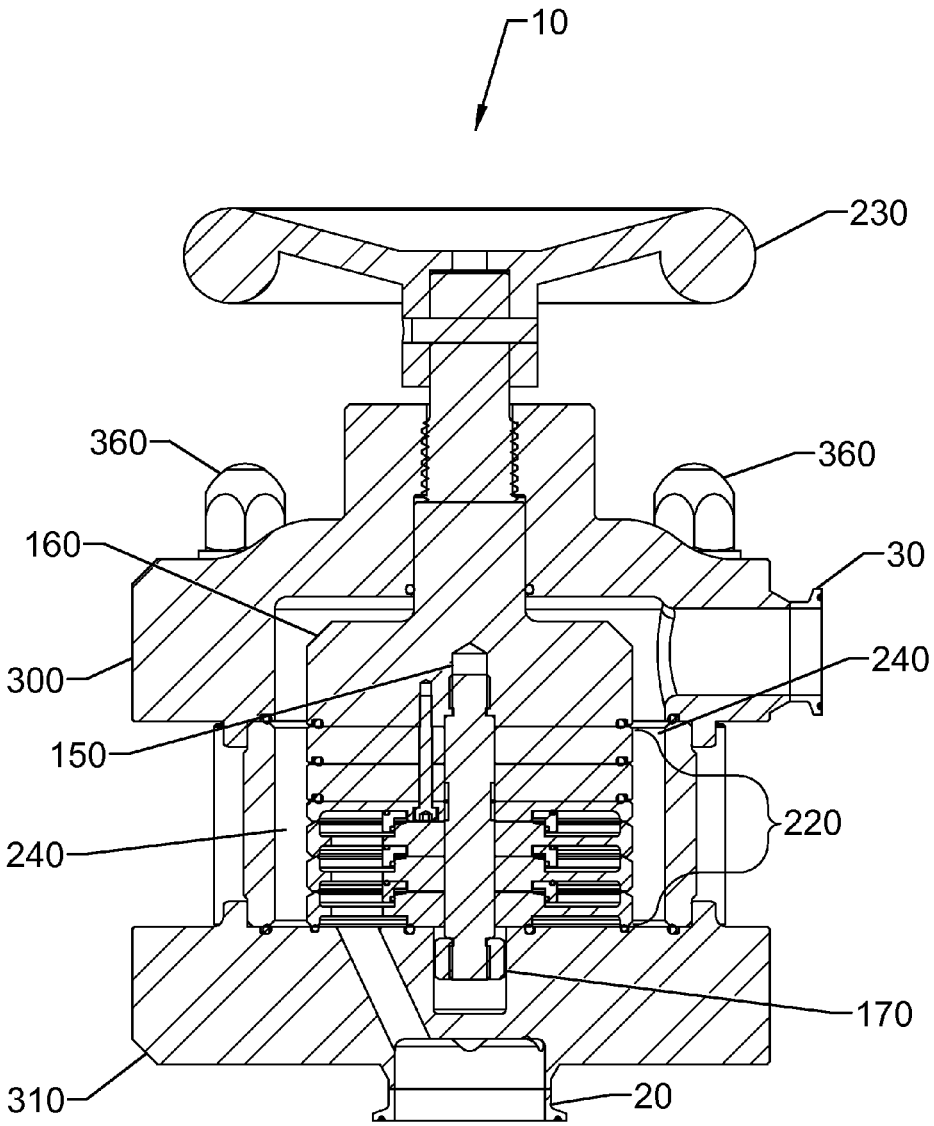
FIG. 2 is a cross-section of the homogenizer 10 of FIG. 1.
Figure 4:
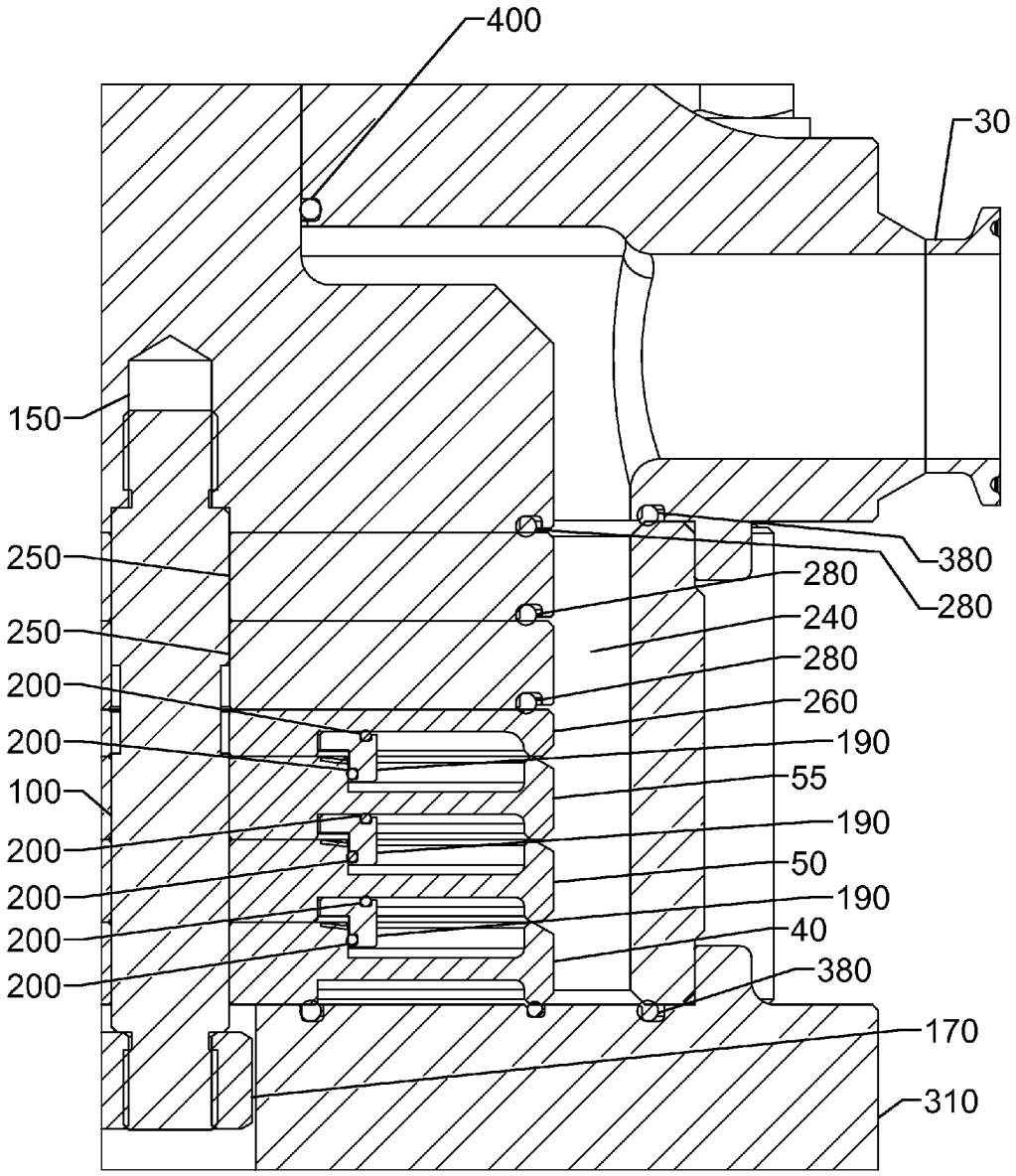
FIG. 4 is a close-up view of a subsection of the cross-sectional view of FIG. 2.

Turning to FIGS. 1, 2 and 4, an exemplary homogenizer which illustrates preferred features of the invention is designated generally by the reference numeral 10. The homogenizer 10 includes a valve plate stack 220 including the first and second valve plates 40, 50 and a third valve plate 55, and an actuator (hand wheel) 230 to apply or relieve compression on the valve plate stack 220. The center stud 100 aligns the valve plate stack 220 and a length of the center stud 100 limits the maximum distance between neighboring valve plates 40, 50, 55 during CIP cleaning, as further discussed below.

Figure 5:
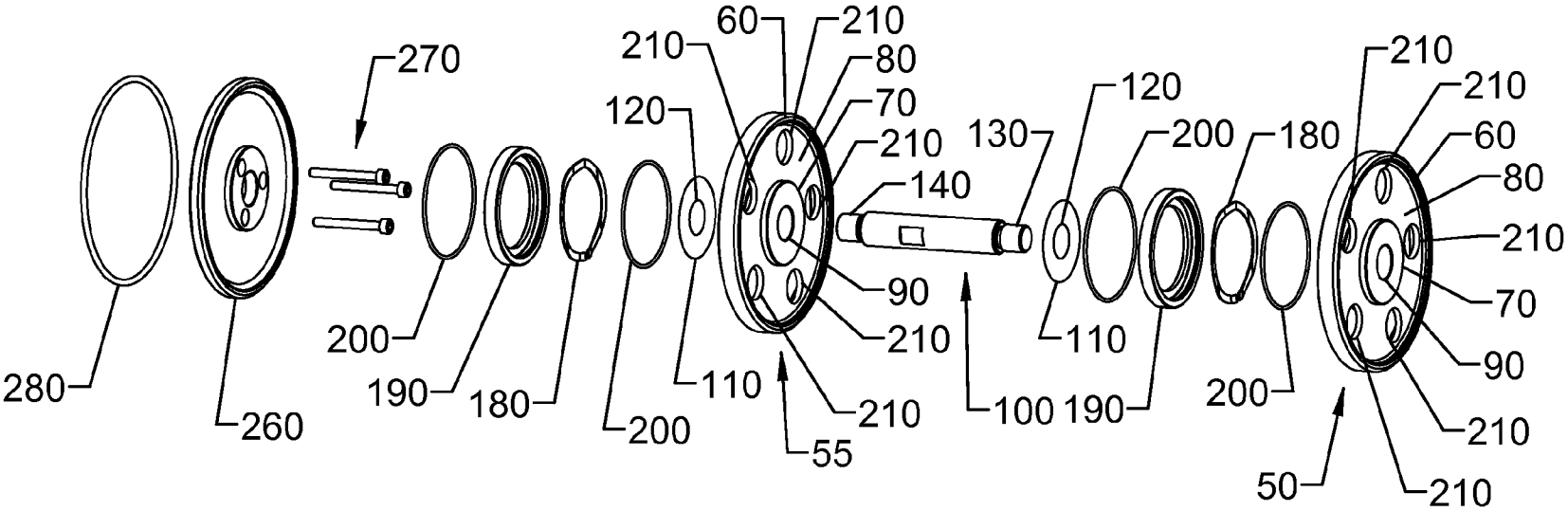
FIG. 5 is a close-up view of a subset of the disassembled components of FIG. 3A.
Figure 6A:
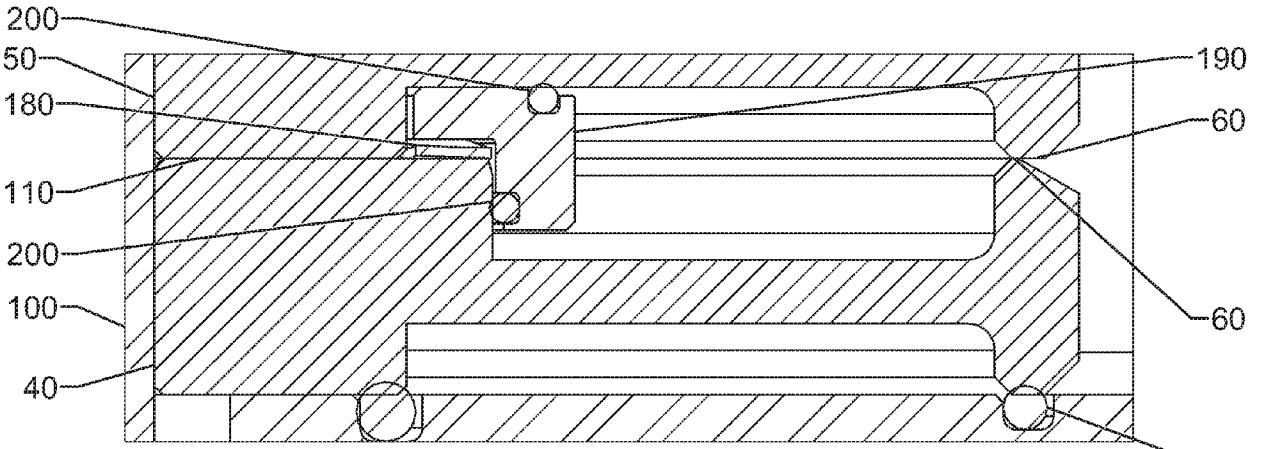
FIGS. 6A and 6B are close-up cross-sectional views of a subsection of FIG. 4, showing a "working position" (FIG. 6A) and a "cleaning position" (FIG. 6B).
Figure 6B:
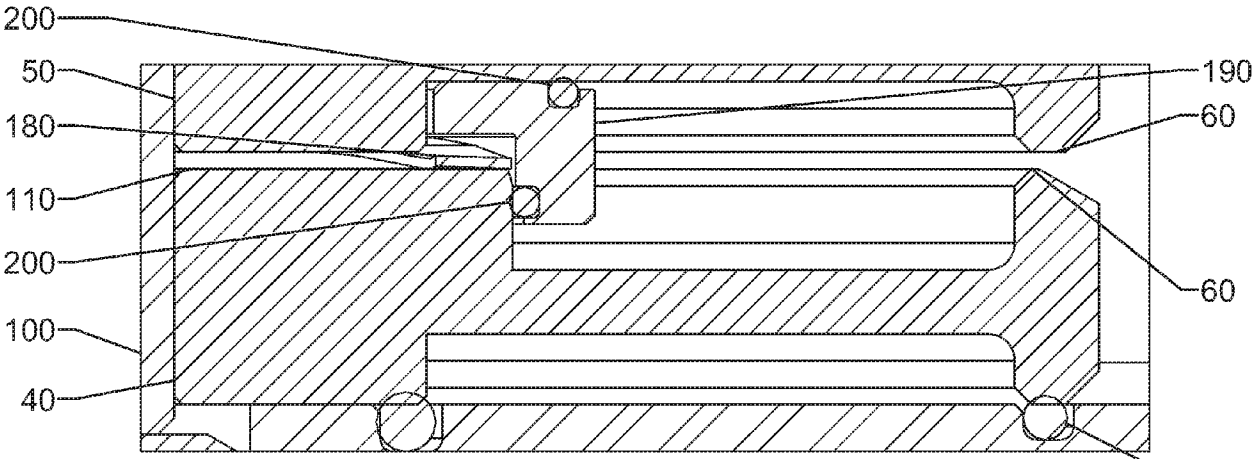

With the valve plate stack 220 fully compressed, product may be homogenized by supplying the product into the inlet 20 of the homogenizer 10. The product may then flow to the face of the lowermost valve plate (here, the first valve plate 40) and travel through the at least one annulus aperture 210 of the first valve plate 40. The annulus apertures 210 provide a passage for fluid to flow between valve plates 40, 50, 55, helping increase homogenizer flow rate. Each valve plate 40, 50, 55 depicted in the version shown in the figures includes five annulus apertures 210 (see FIGS. 3A, 3B, and 5). The product can then flow to subsequent valve plates (such as the second valve plate 50, then the third valve plate 55) and through the annulus apertures 210 thereof. Additionally, the product between valve plates 40, 50, 55 can flow through the valve plate gap between the outer rims 60 of adjacent valve plates 40, 50, 55 to enter the elongated annular cavity 240 surrounding the valve plate stack 220 (see FIG. 2), and from there to the outlet 30. The annular cavity 240 is a low-pressure zone (that is, product experiences lower pressures) relative to the high-pressure valve plate stack 220.

The valve plate gap between adjacent valve plates, through which fluid product flows at high velocity to effect homogenization, is substantially determined by the thicknesses of the shims 110 between the valve plates. The shims 110, which may take the form of very thin gasket-like rings made of foil or other thin material, can each have its thickness chosen to result in a desired valve plate gap (such as about 0.001" to 0.0015" for dairy products). Different sizes may be chosen depending on the product to be processed. Product flow area is determined in large part by the size of the valve plate gaps and the diameters of the valve plates 40, 50, 55, and the number of valve plates can be varied to achieve a desired flow rate. In preferred versions of the homogenizer 10, the valve plates 40, 50, 55 have substantially larger diameters than those in prior homogenizers, and thus a larger flow rate can be achieved. In particular, valve plates 40, 50, 55 may be 4.75" in diameter or larger. In comparison, prior homogenizers typically have plate diameters of about 3.125". The homogenizer 10 can therefore allow a greater flow rate because the flow area is larger, and at the same time, homogenization is more efficient. At the same supply pressure of 1000 psi, the exemplary homogenizer 10 depicted in the figures produced smaller particle size than the aforementioned prior homogenizers.

The springs 180 situated between the valve plates 40, 50, 55 may be fully compressed during homogenization, with the valve plates 40, 50, 55 and shims 110 in solid contact. However, during subsequent CIP operations, the actuator (hand wheel) 230 can relieve the force urging the valve plates 40, 50, 55 toward each other, and the springs 180 can separate the valve plates 40, 50, 55 to create a larger valve plate gap (such as a gap of one millimeter) for CIP. Cleaning fluid can then be supplied to the inlet 20, or further upstream along the product flow line, to flow through the valve plates 40, 50, 55 and their gaps and out of the outlet 30. The springs 180 are isolated from both product and cleaning fluid by the spring retainers 190, which seal against adjacent valve plates via the spring O-rings 200.

Figure 3A:
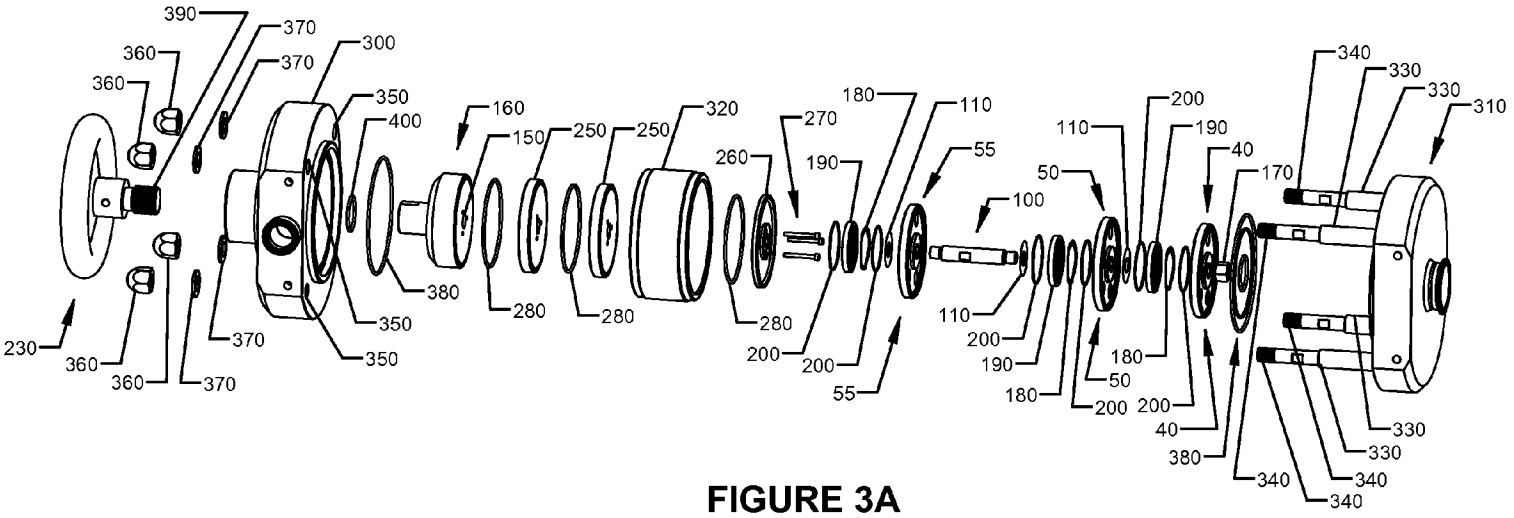
FIGS. 3A and 3B are two views of the disassembled components of the homogenizer 10 of FIGS. 1 and 2.
Figure 3B:
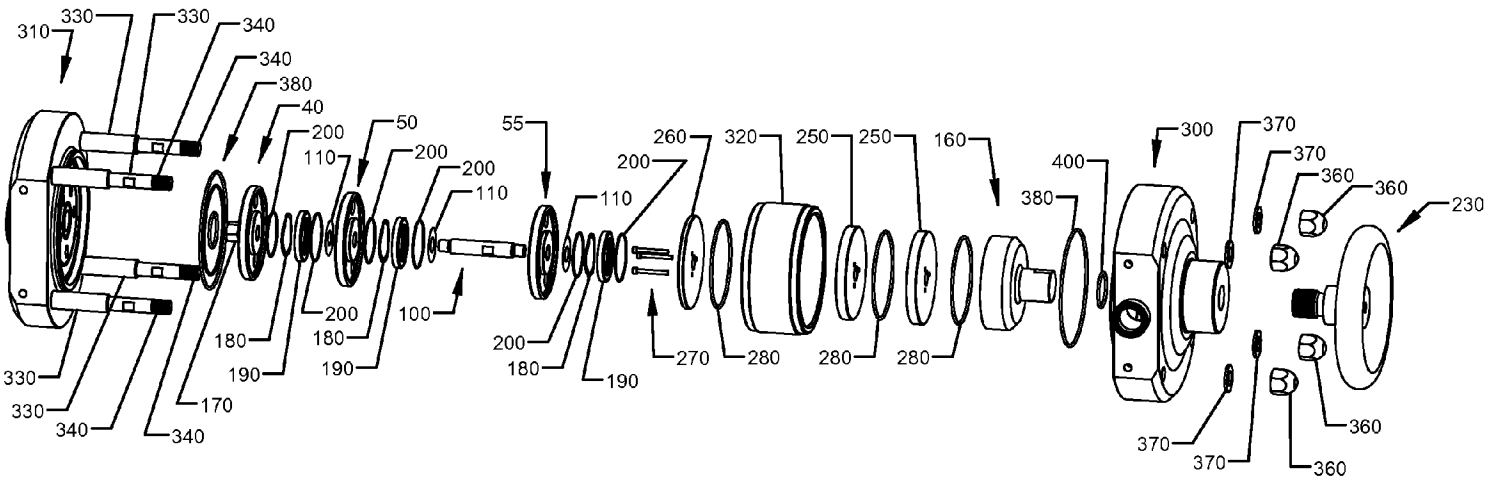

Referring to FIGS. 3A and 3B, the homogenizer 10 includes an actuator (hand wheel) 230 connected to the valve plate plunger 160, which can move up and down when the wheel is rotated clockwise and counterclockwise. Between the valve plate stack 220 and the valve plate plunger 160 are spacers 250 and a stack end plate 260 secured by stack fasteners 270. The spacer O-rings 280 about the spacers 250 help seal the springs 180, shims 110, and center stud 100 from exposure to product and cleaning fluid. When compression from the actuator and valve plate plunger 160 is relieved from the valve plate stack 220, the spacer O-rings 280 remain compressed due to forces from the springs 180, helping prevent product from entering the sealed inner spaces where the springs 180, shims 110, and center stud 100 are located.

During assembly, the valve plates 40, 50, 55 are stacked. The center stud 100 with threads at both ends 130, 140 goes through the hub apertures 90 of the valve plates 40, 50, 55. One of the threaded ends 140 of the center stud 100 is threaded into a threaded hole 150 of the valve plate plunger 160 and the other end 130 is connected to the center stud nut 170. The valve plate stack 220 is positioned between the valve plate plunger 160 and the nut 170. The center stud 100 provides the guide to align the valve plate stack 220, and its length determines the opening distance between the valve plates during CIP. This is because when the compression force from the actuator 230 and plunger 160 is removed, the springs 180 will expand, but the total expansion is limited by the space between the valve plate plunger 160 and the center stud nut 170, minus the thickness of the valve plate stack 220. The valve plate stack 220 is preferably operated in a horizontal orientation (rather than upright with the hand wheel 230 at the top, as depicted in FIGS. 1 and 2) in both working and cleaning positions so as to reduce the effect of gravity along the valve plate stack's 220 axial direction. In the upright position, gravity could cause "upper" plates (that is, the valve plates closer to the hand wheel 230) to have greater valve plate gaps than the "lower" plates, and thus greater flow rates, than the lower plates. Also, in the upright position, the middle annuluses 80 of the valve plates 40, 50, 55 would retain more fluid than in the horizontal position. Thus, each spring 180 will have approximately the same expansion. In preferred versions, a valve plate gap of about one millimeter in CIP will allow an adequate flow rate for cleaning in dairy applications.

In the working position (that is, during homogenization), the springs 180 are compressed until the valve plates 40, 50, 55 and their adjacent shims 110 are in full contact. Because the thicknesses of the valve plates 40, 50, 55 at their rims are about equal to the thicknesses of the inner raised hubs 70 of the valve plates 40, 50, 55, the valve plate gaps between the rims are at least substantially equal to the shim thicknesses at the hubs 70. For conventional dairy products, gaps of 0.001" to 0.0015" are normally sufficient for good homogenization; for other products, different gaps may be more suitable. Gap sizes can be readily varied by changing the shim thicknesses.

On opposing sides of the valve plate stack 220 are a discharge cover 300 having the outlet 30, and the intake cover 310 having the inlet 20. A shell 320 surrounding the valve plate stack 220 is sandwiched between the discharge cover 300 and the intake cover 310. Mounting studs 330 having threaded ends 340 extend from the intake cover 310, and are used to urge the discharge cover 300 and the intake cover 310 about the shell 320. The threaded ends 340 of the mounting studs 330 pass through mounting apertures 350 formed in the discharge cover 300. Mounting nuts 360 and washers 370 engage the threaded ends 340 of the mounting studs 330 to secure the discharge cover 300 to the intake cover 310.

To perform homogenization on a product, the valve plate stack 220 is compressed to its working position. The pressurized product is supplied to the inlet 20 in the intake cover 310, flows through the annulus apertures 210, and is forced out through the valve plate gaps. The flow rate of the product to be processed is dependent on the number of valve plates. The pressure of the product imparts high kinetic energy to the product ejected through the valve plate gaps, and the product thereby exits the gaps at high speed. When this speed (which is dependent on supply pressure) is sufficient, the product flow will experience high shear and cavitation, with bubbles forming in the product and then violently imploding, reducing particle size in the product CIP cleaning can be effected by rotating the hand wheel 230 to relieve compression on the valve plates 40, 50, 55, resulting in expansion of the springs 180 to create wider valve plate gaps between the valve plates 40, 50, 55. As a result, CIP fluid can pass through the valve plate gaps to wash out product remaining between the valve plates 40, 50, 55. All surfaces exposed to product are similarly exposed to cleaning fluid. The springs 180 are inside of the spring retainers 190 and are sealed off by spring O-rings 200 in both the cleaning position and the working position, and are not exposed to fluids.

To assemble the components shown in FIGS. 3A and 3B, the user may screw one threaded end 140 of the center stud 100 into the valve plate plunger 160. One or more spacers 250 and a stack end plate 260 may be slid onto the center stud 100 and secured to the valve plate plunger 160 via fasteners 270. A shim 110 may be slid onto the center stud 100. Two spring O-rings 200 can be placed on the spring retainer 190, a wave spring 180 placed in the spring retainer 190, and the spring retainer 190 installed on the center stud 100. A valve plate 55 may then be slid on the center stud 100. Additional shims 110, springs 180 (in retainers 190 and with O-rings 200), and valve plates 40, 50 may be similarly added. The center stud nut 170 can be screwed onto the other end 130 of the center stud 100 and tightened to complete the valve plate stack 220. The shell 320 may be placed about the valve plate stack 220, and additional cover O-rings 380 may be added to help form a seal between the intake cover 310, the discharge cover 300, and the shell 320. Plunger O-ring 400 helps provide a seal between the valve plate plunger 160 and discharge cover 300. The mounting studs 330 of the intake cover 310 may be aligned with and inserted through the mounting apertures 350 in the discharge cover 300. With the discharge cover 300 sitting on the shell 320, the mounting nuts 360 can be placed onto the mounting studs 330 and tightened to firmly sandwich the shell 320 between the discharge cover 300 and the intake cover 310. A threaded rod 390 extending from the actuator (hand wheel) 230 may then be screwed into the discharge cover 300. The homogenizer 10 should then be assembled as shown in FIGS. 1 and 2. When the hand wheel 230 is rotated (clockwise) until it bottoms out, all shims 110 are in contact with the valve plates 40, 50, 55. The valve plate gaps are formed, and the valve plates 40, 50, 55 are in their working position for homogenization. When the wheel is rotated oppositely (counterclockwise) until little or no upward spring 180 force remains, the valve plates 40, 50, 55 are in their cleaning position, with the springs 180 preferably creating about a one millimeter distance between the valve plates 40, 50, 55, thereby allowing cleaning fluid to pass through with fast speed. In the horizontal position with the outlet 30 facing downwardly, gravity will allow the homogenizer 10 to self-drain.

In operation, the homogenizer 10 may be supplied with fluid product via one or more pumps (such as positive displacement pumps or centrifugal pumps), with the pumps stepping up the input pressure and flow rate to desired levels. This is in contrast with typical homogenizers, which use positive displacement (piston) pumps. Positive displacement pumps are more susceptible to wear and require more maintenance, and also require greater energy to run. In addition, they are not completely cleanable as product can remain in the areas between seal packings and the piston. Because CIP is typically at a lower pressure than operating pressure, the remaining product can be difficult to wash out by CIP cleaning fluid.

It must be kept in mind that the homogenizer 10 shown in the accompanying drawings and discussed above are merely exemplary, and may assume a wide variety of configurations different from those noted, and may use components different from those noted. It should also be understood that various terms referring to orientation and position are used throughout this document—for example, "upper" (as in "upper" plates) and "bottom" (as in "fluid input at the bottom side")—are relative terms rather than absolute ones. In other words, it should be understood (for example) that the bottom side may in fact be located at the top of the apparatus depending on the overall orientation of the apparatus. Thus, such terms should be regarded as words of convenience, rather than limiting terms. Moreover, in the following description, it is to be understood that such terms as "forward," "rearward," "left," "right," "upwardly," "downwardly," and the like are words of convenience and are not to be construed as limiting terms.

Various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

First, although the exemplary homogenizer 10 in the figures incorporates a valve stack 220 with three valve plates 40, 50, 55, any suitable number of valve plates may be incorporated into the homogenizer. Increasing the number of valve plates (to, for example, eight) would provide additional valve plate gaps through which homogenization could be effected.

Second, in an exemplary alternative version, impact rings that align with each valve plate gap may be added to (for example) the shell 320. The product ejected from the valve plate gaps impinges on the impact rings, which assist with breaking particles to smaller sizes. Third, the hand wheel 230 actuator can be replaced by a hydraulic or other actuator. Fourth, although the spring 180 is discussed as a wave spring 180 above, the spring 180 may be any compression spring 180 (such as a helical or coil spring 180) or other suitable elastic object. Fifth, all O-rings discussed above (for example, those used with the spring, spacer, cover, and plunger O-rings) may be conventional O-rings or any suitable gasket. These examples are not to be construed as describing the only additions and modifications to the invention.

Preferred versions of the invention have been described above in order to illustrate how to make and use the invention. The invention is not intended to be limited to these versions, but rather is intended to be limited only by the claims set out below. Thus, the invention encompasses all different versions that fall literally or equivalently within the scope of these claims.

What is claimed is:

1. A homogenizer for reducing the size of particles in fluids, a. the homogenizer including:

i. a first valve plate and a second valve plate, each valve plate having:

1) an outer rim;

2) an inner raised hub with:

a) a hub aperture extending therethrough; and b) a hub thickness; and 3) a middle annulus radially situated between the outer rim and the inner raised hub, the middle annulus having:

a) an annulus aperture extending therethrough; and b) an annulus thickness that is less than the hub thickness;

ii. a shim having a shim thickness that is less than the annulus thickness, the shim:

1) being sandwiched between the inner raised hubs of the first and second valve plates; and 2) having a shim aperture extending therethrough;

iii. a center stud concentrically aligning the first and second valve plates, the center stud extending through:

1) the hub aperture of the first and second valve plates; and 2) the shim aperture;

iv. a spring situated between the first and second valve plates, the spring being biased to push the first and second valve plates apart;

v. an inlet for receiving a fluid into the homogenizer and feeding the fluid towards the first and second valve plates;

vi. an outlet allowing the fluid to exit the homogenizer;

b. wherein:

i. when the homogenizer is in a working position, a valve plate gap between the outer rims of the first and second valve plates is substantially equal to the shim thickness; and ii. fluid entering through the inlet is at least partly homogenized as it travels past the valve plate gap between the outer rims of the first and second valve plates before exiting through the outlet.

2. The homogenizer of claim 1 further including a spring retainer and an O-ring, wherein the spring is isolated from fluids by the spring retainer and the O-ring.

3. The homogenizer of claim 1 wherein when the homogenizer is in the working position, the valve plate gap is between substantially 0.001 inch and substantially 0.003 inch.

4. The homogenizer of claim 1 wherein the outer rim includes a rim thickness that is substantially equal to the hub thickness.

5. The homogenizer of claim 4 wherein in a cleaning position, the spring separates the first and second valve plates such that the valve plate gap is greater than the shim thickness.

6. The homogenizer of claim 5 wherein in the cleaning position, the valve plate gap is between substantially 0.03 inch and substantially 0.05 inch.

7. The homogenizer of claim 1 further including a valve plate plunger, wherein:

a. the valve plate plunger presses the first and second valve plates together to place the homogenizer in the working position; and b. the first and second valve plates are fully compressed such that the first and second valve plates are in full contact with the shim when the homogenizer is in the working position.

8. The homogenizer of claim 1 further including a valve plate plunger having a threaded hole, wherein:

a. the center stud extends from a stud first end to a stud second end, the stud first end being threaded; and b. the threaded stud first end is engaged within the threaded hole of the valve plate plunger.

9. The homogenizer of claim 8 wherein:

a. the stud second end is threaded; and b. the threaded stud second end receives a center stud nut, such that the first and second valve plates are situated between the valve plate plunger and the center stud nut.

10. The homogenizer of claim 1 wherein:

a. the shim includes a shim diameter;

b. each of the inner raised hubs of the first and second valve plates has a hub diameter; and c. the shim diameter is substantially equal to the hub diameters of the inner raised hubs of the first and second valve plates.

11. The homogenizer of claim 1 wherein:

a. the inner raised hubs of the first and second valve plates are in contact with opposing sides of the shim; and b. the spring is situated between the middle annuluses of the first and second valve plates.

12. A homogenizer for reducing the size of particles in fluids, a. the homogenizer including:

i. a first valve plate and a second valve plate adjacent to each other, each valve plate having:

1) an outer rim with a rim thickness;

2) an inner raised hub with:

a) a hub aperture extending therethrough; and b) a hub thickness that is substantially equal to the rim thickness; and 3) a middle annulus radially situated between the outer rim and the inner raised hub, the middle annulus having:

a) an annulus aperture extending therethrough; and b) an annulus thickness that is less than the hub thickness;

ii. a shim having a shim thickness that is less than the annulus thickness, the shim:

1) being situated between the inner raised hubs of the first and second valve plates; and 2) having a shim aperture extending therethrough;

iii. a center stud extending through:
1) the hub aperture of the first and second valve plates; and
2) the shim aperture;
iv. a spring in a spring retainer, the spring being:
1) positioned between the middle annuluses of the first and second valve plates; and
2) biased to push the first and second valve plates apart;
v. an inlet for receiving a fluid into the homogenizer and feeding the fluid towards the first and second valve plates;
vi. an outlet allowing the fluid to exit the homogenizer;
b. wherein:
i. when the homogenizer is in a working position, a valve plate gap between the inner raised hubs of the first and second valve plates is substantially equal to the shim thickness; and
ii. when the homogenizer is in a cleaning position, the valve plate gap between the inner raised hubs of the first and second valve plates is greater than the shim thickness.

13. The homogenizer of claim 12 wherein the center stud concentrically aligns the first valve plate, the second valve plate, and the shim.

14. The homogenizer of claim 12 wherein when the homogenizer is in the working position, the valve plate gap is between substantially 0.001 inch and substantially 0.003 inch.

15. The homogenizer of claim 12 wherein when the homogenizer is in the cleaning position, the valve plate gap is between substantially 0.03 inch and substantially 0.05 inch.

16. The homogenizer of claim 12 wherein fluid entering through the inlet is at least partly homogenized at the outer rims of the first and second valve plates before exiting through the outlet.

17. The homogenizer of claim 12 further including one or more O-rings, wherein the spring is sealed from fluids by the spring retainer and the one or more O-rings.

18. A homogenizer for reducing the size of particles in fluids,
a. the homogenizer including:
i. a first valve plate and an adjacent second valve plate, each valve plate having:
1) an outer rim;
2) an inner raised hub with:
a) a hub aperture extending therethrough; and
b) a hub thickness; and
3) a middle annulus radially situated between the outer rim and the inner raised hub, the middle annulus having:
a) an annulus aperture extending therethrough; and
b) an annulus thickness that is less than the hub thickness;
ii. a shim having a shim thickness that is less than one millimeter, the shim:
1) being sandwiched between the inner raised hubs of the adjacent first and second valve plates; and
2) having a shim aperture;
iii. a center stud concentrically aligning the first valve plate, the second valve plate, and the shim by extending through:
1) the hub aperture of the first and second valve plates; and
2) the shim aperture;
iv. a spring situated between the first and second valve plates, the spring being biased to push the first and second valve plates apart;
v. an inlet for receiving a fluid into the homogenizer and feeding the fluid towards the first and second valve plates;
vi. an outlet allowing the fluid to exit the homogenizer;
b. wherein:
i. when the homogenizer is in a working position, a valve plate gap between the outer rims of the first and second valve plates is not greater than the shim thickness;
ii. when the homogenizer is in a cleaning position,
1) the valve plate gap between the inner raised hubs of the first and second valve plates is greater than the shim thickness; and
2) the spring is sealed by the spring retainer and the O-ring to reduce exposed crevices; and
iii. fluid entering through the inlet is at least partly homogenized as it travels between the outer rims of the first and second valve plates before exiting through the outlet.

19. The homogenizer of claim 18 wherein:
a. when the homogenizer is in the working position, the valve plate gap is between substantially 0.001 inch and substantially 0.002 inch; and
b. when the homogenizer is in the cleaning position, the valve plate gap is between substantially 0.03 inch and substantially 0.05 inch.

20. The homogenizer of claim 18 further including a spring retainer and an O-ring, wherein the spring is:
a. situated between the middle annuluses of the first and second valve plates; and
b. sealed from fluids by the spring retainer and the O-ring.

* * * * *